US010102834B2

(12) United States Patent
Piñuela Irisarri et al.

(10) Patent No.: US 10,102,834 B2
(45) Date of Patent: Oct. 16, 2018

(54) METHOD, DEVICE AND COMPUTER PROGRAM PRODUCT FOR SCROLLING A MUSICAL SCORE

(71) Applicant: NEWMUSICNOW, S.L., Larrageta, Navarra (ES)

(72) Inventors: Carlos Piñuela Irisarri, Navarra (ES); Sergio Peñalver Primo, Navarra (ES); Koldo Abrego Primo, Navarra (ES)

(73) Assignee: NEWMUSICNOW, S.L., Larrageta, Navarra (ES)

( * ) Notice: Subject to any disclaimer, the term of this patent is extended or adjusted under 35 U.S.C. 154(b) by 75 days.

(21) Appl. No.: 15/124,830

(22) PCT Filed: Mar. 12, 2015

(86) PCT No.: PCT/EP2015/055222
§ 371 (c)(1),
(2) Date: Sep. 9, 2016

(87) PCT Pub. No.: WO2015/136051
PCT Pub. Date: Sep. 17, 2015

(65) Prior Publication Data

US 2017/0018262 A1 Jan. 19, 2017

(30) Foreign Application Priority Data

Mar. 12, 2014 (EP) ..... 14382089

(51) Int. Cl.
*G10G 1/00* (2006.01)
*G10H 1/00* (2006.01)
*G10H 1/40* (2006.01)

(52) U.S. Cl.
CPC ..... *G10G 1/00* (2013.01); *G10H 1/0008* (2013.01); *G10H 1/40* (2013.01);
(Continued)

(58) Field of Classification Search
CPC ..... G10G 1/00; G10H 1/0008
See application file for complete search history.

(56) References Cited

U.S. PATENT DOCUMENTS 3,403,591 A * 10/1968 Weitzner ..... G09B 15/00 84/464 A
5,894,100 A * 4/1999 Otsuka ..... G09B 15/04 84/477 R (Continued)

FOREIGN PATENT DOCUMENTS

| | | |
|---|---|---|
| EP | 2 690 618 | 1/2014 |
| JP | 2009-230006 | 10/2009 |
| KR | 2014 0009699 | 1/2014 |

OTHER PUBLICATIONS

P. Bellini et al., "Managing Music in Orchestras", Computer, IEEE, US, vol. 32, No. 9, Sep. 1, 1999, 13 pages.

(Continued)

*Primary Examiner* — Robert W Horn

(57) ABSTRACT

A method for scrolling a musical score on a screen of a device, comprising: loading a file having a digital score in a piece of memory of said device, wherein said digital score is in a digital format for representing musical notation; displaying a plurality of notes or at least one measure from said score on the screen. The method further comprises: scrolling said score in a continuous way by moving the notes or measures displayed on the screen, in such a way that additional notes of music or additional measures start to appear on the screen while the already scrolled notes or measures start to disappear from the screen; adjusting the scrolling speed according to the displayed notes or measures and to a tempo. Device, computer program product and computer-readable memory/medium.

21 Claims, 12 Drawing Sheets

(52) U.S. Cl.
CPC . *G10H 2210/385* (2013.01); *G10H 2220/015* (2013.01); *G10H 2220/096* (2013.01)

(56) References Cited

U.S. PATENT DOCUMENTS

| | | | | |
|---|---|---|---|---|
| 6,740,802 | B1 * | 5/2004 | Browne, Jr. | G10H 1/0025 84/609 |
| 7,064,261 | B2 * | 6/2006 | Shao | G10G 1/00 84/470 R |
| 7,482,529 | B1 * | 1/2009 | Flamini | G10H 1/0008 84/609 |
| 7,579,541 | B2 * | 8/2009 | Guldi | G09B 15/00 84/470 R |
| 7,649,134 | B2 * | 1/2010 | Kashioka | G10G 1/00 84/486 |
| 7,893,337 | B2 * | 2/2011 | Lenz | G09B 15/02 84/470 R |
| 8,338,684 | B2 * | 12/2012 | Pillhofer | G09B 15/00 84/470 R |
| 8,445,766 | B2 * | 5/2013 | Raveendran | G10G 1/00 84/470 R |
| 8,530,735 | B2 * | 9/2013 | Maebius | G10H 1/0008 84/612 |
| 9,324,243 | B2 * | 4/2016 | Soejima | G09B 15/002 |
| 9,747,876 | B1 * | 8/2017 | Clarke | G10G 1/00 |
| 9,865,241 | B2 * | 1/2018 | Colafrancesco | H05K 999/99 |
| 10,008,190 | B1 * | 6/2018 | Elson | G10H 1/0008 |
| 2003/0110925 | A1 | 6/2003 | Sitrick et al. | |
| 2003/0110926 | A1 * | 6/2003 | Sitrick | G09B 15/023 84/477 R |
| 2003/0189582 | A1 * | 10/2003 | Pinsky | G09B 15/02 345/684 |
| 2008/0196575 | A1 * | 8/2008 | Good | G09B 15/04 84/470 R |
| 2011/0277615 | A1 * | 11/2011 | Kendler | G10G 1/00 84/483.2 |
| 2017/0018262 | A1 * | 1/2017 | Pinuela Irrisarri | G10G 1/00 |

OTHER PUBLICATIONS

International Search Report and Written Opinion, PCT/EP2015/055222, European Patent Office, dated Apr. 14, 2015, 17 pages.

K. MacDonald "These scrolling music manuscripts are the internet at its most beautiful", 9 pages, Mar. 13, 2017, XP055406379, "These scrolling music manuscripts are the Internet at its most beautiful" : p. 3 "Bach Partita for violin No. 2", URL = http://web.archive.org/web/20150219113734/http://www.classicfm.com/composers/bach/guides/scrolling-music-project/.

Extended European Search Report, European Patent Office, European Patent Application No. 14382089.2, dated Jun. 30, 2014, 7 pages.

* cited by examiner

METHOD, DEVICE AND COMPUTER PROGRAM PRODUCT FOR SCROLLING A MUSICAL SCORE

TECHNICAL FIELD

The present invention relates to the field of displaying and scrolling information on a displaying screen and, in particular, to methods and systems for displaying and scrolling music on a display screen.

STATE OF THE ART

It is well-known that musicians sometimes use virtual scores or electronic scores, rather than conventional paper ones. Electronic scores have meant, among other advantages, appreciable savings in terms of paper and, as a consequence, space.

One of the main challenges faced by electronic scores has been how to scroll or advance virtual sheet music for a user playing an instrument. Probably, the first related record, although not specific for music scores, is the no called teleprompter. The teleprompter is a device based on a display, which provides a person who is speaking with the electronic visual text that must be read. The person using the teleprompter does not need to look down to read his/her notes, as a consequence of which he/she gives an impression of having memorized the speech. Therefore, teleprompter is especially useful in television, for example for the news' readers. The development of software has led to modern teleprompters, which can work on desktop, laptop or tablet computers, and which enable the speaker to control the rate and flow of their speech.

It is also worth mentioning how specific the musical language is, to the point that it is incomparable to any language based on words. As a matter of example, digitalization of musical scores is still an unsolved problem (or at least a problem solved with tough restrictions). In comparison to language digitalization, which has become a routine thanks to the Optical Character Recognition (OCR) system, an existing equivalent system for music, called Optical Music Recognition (OMR), has not managed to work reliably. This is because an error in a word can easily be overcome by mechanisms based on logic, which work in a similar way as the human brain, in such a way that a missing or mistaken letter does not affect a word, which can be contextually reconstructed. A music note, however, cannot be guessed by context. As a matter of example, some studies have concluded that the error when digitalizing musical scores is around 40% for hand-written scores and around 24% for non-hand-written scores (David Carretero de la Rocha, Diploma Thesis, "Sistema de reconocimiento de partituras musicales", University Carlos III de Madrid).

Focusing on music scores, current solutions for displaying electronic scores are based on a page-by-page system. This means that electronic scores are stored page by page on a storage medium. The display device then scrolls the pages statically, one after another. When a page has been shown for a certain time period, that page disappears from the screen and the following page is shown. At the end of that certain time period, the portion of musical notes that is shown on the screen (that is to say, that page or slide) is automatically replaced with a subsequent portion of musical notes (that is to say, with a subsequent page or slide), which again stays on the screen for a certain time period. For example, U.S. Pat. No. 7,098,392B2 discloses a method for providing for video display of music responsive to the music data stored in a music database. In this method, first a page of music image data from a music database is defined; next ordered logical sections within that page are defined; then the mapping is stored in a memory for selective retrieval; finally the video display of the music responsive to the mapping and the storing is provided. Music is always displayed in a static way. In other words, the scroll of music is made page-by-page or slide-by-slide, meaning that when a page (or section or slide) has been shown for a certain time, that page (or section or slide) abruptly disappears from the screen and the following page (or section or slide) is abruptly shown. This means that the music information is not flowing or scrolling in a continuous way, but is statically displayed for a certain time period in the form of pages (or sections or slides). This prevents the player from reading in advance the music that has not been played yet, because when a player is playing the last notes shown on the screen, he/she cannot read in advance the next measures/notes that will be displayed in the following page/slide/section.

The problem of how quickly or slowly to scroll or advance virtual scores for a user playing an instrument, has already been addressed. In other words, in the musical world, there is an unavoidable need for scrolling the music notes according either to the real-time tempo of the user who is actually playing, or to the tempo imposed by the person who conducts a group of musicians, or to the tempo established by the composer in the score itself.

For example, U.S. Pat. No. 8,530,735B2 describes a method for displaying music on a display screen in which, while a portion of musical notes of a song are displayed on the screen and at the same time the player is playing his/her instrument, a tempo of the user's performance of the song is detected. Once the user's tempo is known, it is calculated the time period required by the player to complete the performance of that displayed portion of musical notes. At the end of that time period, the portion of musical notes that is shown on the screen, is automatically replaced with a subsequent portion of musical notes. In other words, the disclosed method works on a page-by-page basis.

This disclosure has several limitations. The main one is that it is only capable of scrolling the music notes according to the real-time tempo of the user who is actually playing. In particular, it is unable to adapt to the tempo suggested by the composer (and represented by annotations in the score). Another disadvantage of this method, as well as of any other conventional method based on a page-by-page display, is that it is unable to manage repetitions, so frequent in musical scores. This means that the only way for a player to repeat a group of musical notes which must be repeated, is to manually go back to the beginning of the group to be repeated.

DESCRIPTION OF THE INVENTION

It is an object of the present invention to provide a method for scrolling musical scores on a display or screen, which overcomes the mentioned disadvantages.

According to an aspect of the present invention, there is provided a method for scrolling a musical score on a screen of a device, comprising: loading a file having a digital score in a piece of memory of said device, wherein said digital score is in a digital format for representing musical notation; displaying a plurality of notes from said score on the screen. The method further comprises: scrolling said score in a continuous way by moving the notes displayed on the screen, in such a way that additional notes of music start to gradually appear on the screen while the already scrolled notes start to gradually disappear from the screen; adjusting the scrolling speed according to the displayed notes and to a tempo, wherein said tempo comprises a reference musical figure with respect to which said displayed notes can be represented and a value indicating the amount of reference musical figures to be played per time unit.

In a particular embodiment, the scrolling speed is calculated as follows: estimating the time T required for playing the notes displayed on the screen at a certain time instant according to the following formula: $T=\Sigma_{i=1}^{N}T_{note_i}$ note wherein N is the total number of notes displayed on the screen to be played sequentially. N being read from the digital score, and $T_{note_i}$=(amount of reference musical figures in note_i)/tempo value; obtaining from the device the dimensions of the screen, thus calculating the space to be covered by those displayed notes; calculating the scrolling speed from said estimated time T required for playing the displayed notes and from said calculated space to be covered by said notes and continuously scrolling the score at said calculated speed; repeating said calculation and adjusting the scrolling speed every time at least one new note appears on the screen.

In a particular embodiment, the digital score is scrolled either vertically or horizontally, wherein when vertical scroll is used, the displayed notes are moved from bottom to top on the screen and wherein when horizontal scroll is used, the displayed notes are moved from right to left on the screen.

In a particular embodiment, the tempo is selected from the following group of tempos: according to the real-time tempo of the user who is actually playing, according to the tempo indicated in the digital score or, when a group of users are playing together, according to the tempo imposed by one of them.

According to another aspect of the present invention, there is provided a method for scrolling a musical score on a screen of a device. The method comprises: loading a file having a digital score in a piece of memory of the device, the score comprising a plurality of measures; displaying a at least one measure from the score on the screen; scrolling the score in a continuous way by showing on the screen additional measures of music while the already scrolled measures disappear from the screen; adjusting the scrolling speed according to the displayed measures, to a tempo and to a number of beats per measure. The tempo is selected from the following group of tempos: according to the real-time tempo of the user who is actually playing, according to the tempo indicated in the digital score or, when a group of users are playing together, according to the tempo imposed by one of them. The number of beats per measure are selected from the following group: according to the number of beats per measure imposed by the user who is actually playing, according to the number of beats per measure indicated in the digital score or, when a group of users are playing together, according to the number of beats per measure imposed by one of them.

In a particular embodiment, the digital score is scrolled vertically. In this case, the scrolling speed is preferably calculated as follows: estimating the time T required for playing said at least one measure according to the following formula: $T=\Sigma_{i=1}^{N}T_{measure_i}$, wherein N is the total number of measures displayed on the screen. N being read from the digital score, and $T_{measure_i}$=n_beats$_{measure_i}$/tempo, wherein "tempo" is either the tempo indicated in the digital score or a tempo imposed by the user and n_beats$_{measure_i}$ is the number of beats that the measure number "i" has, said number being either read from the digital score or imposed by the user; obtaining from the device the dimensions of the screen, thus calculating the space to be covered by the at least one measure; calculating the scrolling speed from the estimated time T required for playing the measures displayed on the screen and from the calculated space to be covered by the measures and scrolling the score at the calculated speed; repeating the calculation and adjusting the scrolling speed every time the screen is refreshed.

In a more particular embodiment within the vertical scrolling, wherein a plurality of musical lines K is shown on the screen, each of the lines having at least one measure Mk, the number of measures per line being variable from line to line, the scrolling speed is calculated as follows: estimating the time $T_k$ required for playing each musical line shown on the screen as follows: $T_k=\Sigma_{i=1}^{Mk}T_{measure_i}$, wherein k varies from 1 to K. K being the total number of lines shown on the screen, wherein Mk is the number of measures in line k, and $M_1\ M_2 \ldots M_k \ldots M_K$ being read from the digital score; calculating the total time T required for playing the Mk lines shown on the screen as follows: $T=\Sigma_{k=1}^{K}T_k$; calculating an average time $T_{av}$ per line:

$$T_{av} = \frac{T}{K};$$

rounding off said $T_{av}$ to the lower natural number; calculating the scrolling speed from said estimated time $T_{av}$ required for playing the measures displayed on the screen and from said calculated space to be covered by said measures and scrolling the score at said calculated speed; repeating said calculation and adjusting the scrolling speed every time the screen is refreshed.

In an alternative embodiment, the digital score is scrolled horizontally. In this case, the scrolling speed is preferably calculated as follows: every time a measure i starts to be displayed on the screen: estimating the time T required for playing that measure as follows: $T_{measure_i}$=n_beats$_{measure_i}$/tempo, wherein "tempo" is either the tempo indicated in the digital score or a tempo imposed by the user and n_beats$_{measure_i}$ is the number of beats that the measure number "i" has, said number being either read from the digital score or imposed by the user; obtaining from the device the length of the screen, thus calculating the space to be covered by that measure i; reading from the digital score the length of the measure i; calculating the scrolling speed by dividing the sum of the space to be covered by that measure and the length of that measure by the estimated time T required for playing said measure; and scrolling the score in a continuous way at that calculated speed.

In a particular embodiment, the method further comprising the steps of: identifying in the digital score at least one mark which indicates the repetition of one block of music; copying that block to be repeated; —pasting in the file as many repetitions as indicated by the at least one mark, in a concatenated way, thus allowing the user to play the music in a linear way, avoiding the need of going back in the digital score.

In a particular embodiment, the method can be carried out by a plurality of users playing simultaneously the same score, the digital score being shown in a device of each user.

Preferably, the digital score is in the MusicXML format. Alternatively, it is in the Standard MIDI File (SMF) format or in the MXL format.

According to another aspect of the present invention, a device is provided. The device comprises means for carrying out the method previously explained. This device can be a personal digital assistant (PDA), a portable reader device, a tablet, a cell phone or any device which comprises a memory, a processor and a screen or display.

According to final aspects of the present invention, a computer program product comprising computer program instructions/code for performing the method already described, is provided. And a computer-readable memory/medium that stores program instructions/code for performing the method already described, is provided.

Additional advantages and features of the invention will become apparent from the detail description that follows and will be particularly pointed out in the appended claims.

BRIEF DESCRIPTION OF THE DRAWINGS

To complete the description and in order to provide for a better understanding of the invention, a net of drawings is provided. Said drawings form an integral part of the description and illustrate an embodiment of the invention, which should not be interpreted as restricting the scope of the invention, but just as an example of how the invention can be carried out. The drawings comprise the following figures.

DESCRIPTION OF A WAY OF CARRYING OUT THE INVENTION

Figure 1:
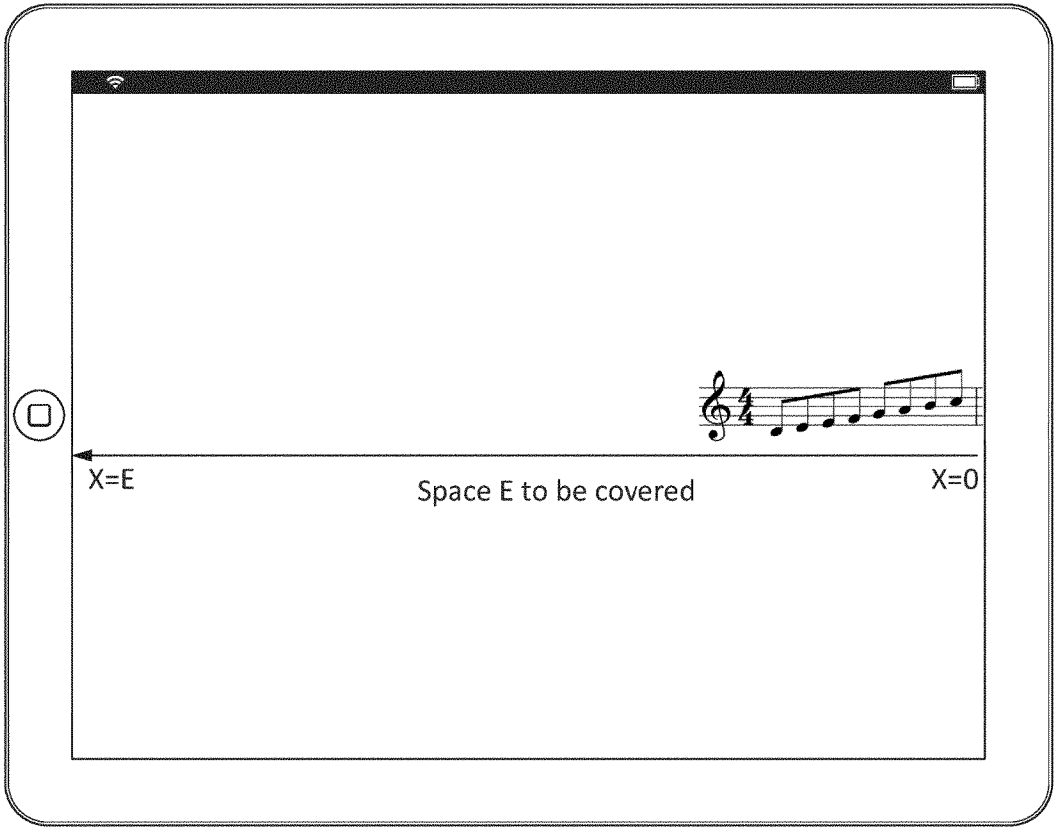
FIG. 1 shows a scheme of horizontal scrolling (displacement) of a measure.

In this text, the term "comprises" and its derivations (such as "comprising", etc.) should not be understood in an excluding sense, that is, these terms should not be interpreted as excluding the possibility that what is described and defined may include further elements, steps, etc.

In the context of the present invention, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

The following description is not to be taken in a limiting sense but is given solely for the purpose of describing the broad principles of the invention. Next embodiments of the invention will be described by way of example, with reference to the above-mentioned drawings showing apparatuses and results according to the invention.

The method described herein is mainly designed to run on an electronic device, such as a personal digital assistant (PDA), a portable reader device, a tablet, a cell phone containing a display or any device which comprises a memory, a processor and a screen or display. The method is preferably implemented as a software application (APP). Also, the method is designed to run simultaneously in a plurality of such devices, for example when an orchestra or any other group of musicians is playing together. In that situation, one of the devices works as a "master" while the remaining devices are synchronized to the "master" one. In this context, "synchronized" means that the master device decides in which musical point (for example, a certain measure) all the remaining devices are (although those devices can display on their respective screens different notes or different amount of notes) and/or selects the tempo to be played.

In the context of this invention, the terms "system" and "line", referred to a musical score, are interchangeable. Strictly speaking, a musical line is a stave or staff ("pentagrama" in Spanish) corresponding to a single instrument, while a musical system ("sistema" in Spanish) comprises several lines referring to the same portion of music, each corresponding to a different instrument or to the two hands of a piano player or to the music to be played by certain instruments which use systems. Typically, the score of an orchestra conductor has systems, while the scores of each of the players of different instruments, have lines (staves).

Similarly, in this context, the term "score" is used to refer to both the sheet music used by the conductor, that is to say, the sheet music which contains simultaneously, all the sounds that all the musicians should make when they play together (in Spanish, "partitura"), and the sheet music of a single musician who plays one instrument (in Spanish, "particella"; in English "part").

Unlike conventional methods of scrolling scores, which are based on a page format, the method enables music to be read linearly, as music really is. Paper sheet music includes lines of music arranged horizontally on a page. Within each line, there are smaller units known as measures (in Spanish, "compases"). A measure is a musical structure delimited by vertical bars. It makes reading and playing music easier. Within the bars, a group of musical notes is delimited. A "measure indication" defines the number of beats in each measure. This, together with the "tempo indication", permits to calculate the duration of each measure. Within each measure, there are individual musical notes, depicted by a variety of different symbols.

Musical metric figures or simply musical figures are individual signs, including signs representing sounds (these signs are called "notes") and signs representing musical silence (these signs are called "rests"). Each sign (notes and rests) represents within a measure a certain time period (a period of sound or a period of silence, respectively).

There is a relationship between the duration in time of different musical figures (notes and rests). The relationship between notes of a non-exhaustive list of musical notes is the following: 1 Whole note (or Semibreve)=2 Half note (or Minim)=4 Quarter note (or Crotchet)=8 8th (Eighth) note (or Quaver)=16 16th (Sixteenth) note (or Semiquaver)=32 32nd (Thirtysecond) note (or Demisemiquaver)=64 64th (Sixty-fourth) note (or Hemidemisemiquaver)=128 128th (Hundred and twenty-eighth) note (or Semihemidemisemiquaver) =256 156th (Hundred and fifty-sixth) note=512 512$^{nd}$ (five hundred and twelveth) note. And there is also: 1 Longa=2 Double whole note (or Breve)=4 Whole note (or Semibreve). The former relationship has a corresponding silence sign (rest) with same duration. As already mentioned, this is merely an exemplary list of commonly used notes, but there are other notes not included in this list. Additionally, there are irregular groups of figures (called "Tuplets"), wherein a group of notes of a certain figure has the same equivalence in terms of time duration as the same group of figures minus one. For example: Triplet of $8^{th}$ (eighth) note=two $8^{th}$ (eighth) notes.

So, each conventional note can be divided into a certain amount of "reference musical figures". A "reference musical figure" (also referred to as "reference figure" from now on) can be any of the former notes (whole note, half note, quarter note, $8^{th}$ note, etc.) which is taken as a reference along a score or a portion of a score. For example, if the 16th (Sixteenth) note is taken as "reference figure", then, the whole note is made of sixteen reference figures. If, however, the quarter note is taken as "reference figure", then, the whole note is made of four reference figures.

An empty measure sign, which refers to a whole measure which is empty (without notes), has a time duration of a certain number of beats (indicated in the score or by the conductor (musician)).

Tempo, which is normally expressed as beats per minute (BPM), controls the rate at which the musical notes in a line (or in general, in a score) of music are played. In a digital score, tempo is defined or expressed as a "reference figure" and a "value" (in particular, in musical language, as "reference figure=value"), wherein the "value" represents how many times that "reference figure" (or any equivalent ones) must be played in one minute. For example, if a tempo is defined as "quarter note=50" BPM, it means that in one minute 50 quarter notes (or any equivalent figures) must be played. The tempo is indicated in the musical score and can vary along the score. The tempo can also be imposed by the conductor or by the player. Usually in conventional paper scores "tempo" is indicated with a text (for example, "allegro"). When conventional paper scores are converted into digital ones, conventional wording is not recognized and that "tempo" is expressed as the mentioned "reference figure=value". For example, "allegro" is conventionally expressed as "Quarter note=120" BPM.

The scores must be in a digital format. The scores are in a format for representing, understanding and/or providing musical notation, that is to say, in a format which enables to unequivocally obtain all the symbols comprised in a score. In other words, the format must be a musical notation format, unlike other digital formats, such as PDF, TIFF, JPG, BMP, EPS, PostScript or others. In a preferred embodiment, the scores are in the MusicXML format or Standard MIDI File (SMF) format or M)(L format, which are well-known formats for representing musical notation. For example, the MusicXML format is a XML-based proprietary format for representing musical notation, but fully and openly documented. The MusicXML standard contains information such as title, author, number of measures, number of systems, instrument number and name, position and duration of notes, and, generally, the same information as provided by a paper score. The MusicXML format was first designed for exchanging scores, in particular among different score editors. MIDI (Musical Instrument Digital Interface) is a technical standard that describes a protocol, digital interface and connectors and allows a wide variety of electronic musical instruments, computers and other related devices to connect and communicate with one another. MIDI carries event messages that specify notation, pitch and velocity, control signals for parameters such as volume, vibrato, audio panning, cues, and clock signals that set and synchronize tempo between multiple devices. These messages are sent to other devices where they control sound generation and other features. This data can also be recorded into a hardware or software device called a sequencer, which can be used to edit the data and to play it back at a later time. The Standard MIDI File (SMF) is a file format that provides a standardized way for sequences to be saved, transported, and opened in other systems.

The method is implemented as computer program instructions/code which runs on one or more of the previously mentioned devices. It also requires storage means for storing the music scores (in the form of digital files). This storage can be local or distributed, such as in the cloud. Optionally, additional hardware can be used, such as pedals for hands-free operation.

Once a score in a musical notation format, also referred to as a digital format, which enables to unequivocally obtain all the symbols comprised in a score, such as MusicXML, Standard MIDI File (SMF) format or MXL format, has been open at a local device (either stored locally or in the internet, for example with restricted access) the contents of the score are drawn on the screen. The format is preferably MusicXML. These contents are adapted to the screen of the device. From now on, the term "file" refers to a file in a digital format (musical notation format) comprising a whole musical score. The file is preferably loaded in the device and stored locally in a buffer within the memory of the device.

The process of displaying the score kept in the file is as follows: First, the contents of the file stored in the buffer are read. Then, the total height of the score is calculated in order to, by default, display the full score. The width is adapted to that of the screen in which it is displayed. In other words, by default, as many music lines as required are shown/drawn, in order to show on the screen all the notes of the score along the width of the screen. Since, however, for practical reasons, only a certain amount of "lines" can be shown on the screen (for the user to be able to read them), a scrolling or displacing function is activated, as detailed later on.

Once the contents of the file stored in the buffer are read, the repetitions are expanded. This means that those measures (or in general, notes) that should be played more than once, are concatenated in a row as many times as repetitions marked in the score, according to a specific notation in the score. The annotations corresponding to repetitions are marked in the digital file. Thanks to these marks, the algorithm knows which portions must be expanded and how many times they must be expanded (copied in a concatenated way). In other words, the measures (or in general, notes) which belong to a block (marked for repetition) are copied and pasted as many times as required, exactly at the point in the file where the mark is placed. This process fills the buffer with the score fully "expanded". In this process, a pre-buffer is stored in a temporary buffer for subsequent use. Due to the fact that musicians are used to read music with repetitions and their symbology, the repetitions are preferably expanded on the screen only at the moment of displaying the portion of music to be repeated (during the scrolling of the score). Otherwise, musicians might not "recognize" the score. Therefore, when the scrolling is not active, the non-expanded score in kept in a buffer. When the scroll is activated, the repetitions are expanded and the expanded score is stored in another buffer. Finally, the score is drawn on the screen according to the contents of this buffer (expanded score). The user can therefore read and interpret music in a linear fashion, avoiding the need of going back in the digital score.

One of the main advantages of the method is that it provides a means for adapting the speed at which the score is shown on the screen, based on the displayed measures (or more generally notes) and on the tempo. As already explained, music is a very particular "language" in which the content of a line (or in general, of a conventional page) is of variable time length. Therefore, it is desirable to adapt the scrolling according to the content of the score, and in particular, to the music displayed on the screen. Besides, it is desirable to adapt the scrolling according to different "tempos": according to the real-time tempo of the user who is actually playing, according to the tempo suggested by the composer (and represented by annotations in the score) or even, when a group of musicians are playing together, according to the tempo imposed by one of them. How this speed is calculated is explained next.

Once drawn, the speed at which to scroll is calculated, according to a default tempo as specified in the score. This default tempo is read or understood thanks to the score being in a digital format (musical notation format), such as MusicXML, Standard MIDI File (SMF) format or MXL. Alternatively, the user can net this tempo manually (for example with his/her hands or by means of pedals).

The score can be scrolled either vertically or horizontally. The algorithm calculates the speed at which music (measures or notes) should move on the screen, either vertically or horizontally, in such a way that the user is able to read it and interpret it, thus playing his/her instrument without interruptions and in a linear way. In other words, the scrolling speed should be the one a musician would need, to conventionally read a music line from left to right according to the established tempo.

Tempo is indicated in beats per time unit. Preferably, tempo is indicated in beats per minute (bpm or BPM). It is remarked that this is equivalent to the definition of tempo as "reference figure=value"), because in general the reference figure refers to one beat.

Figure 2:
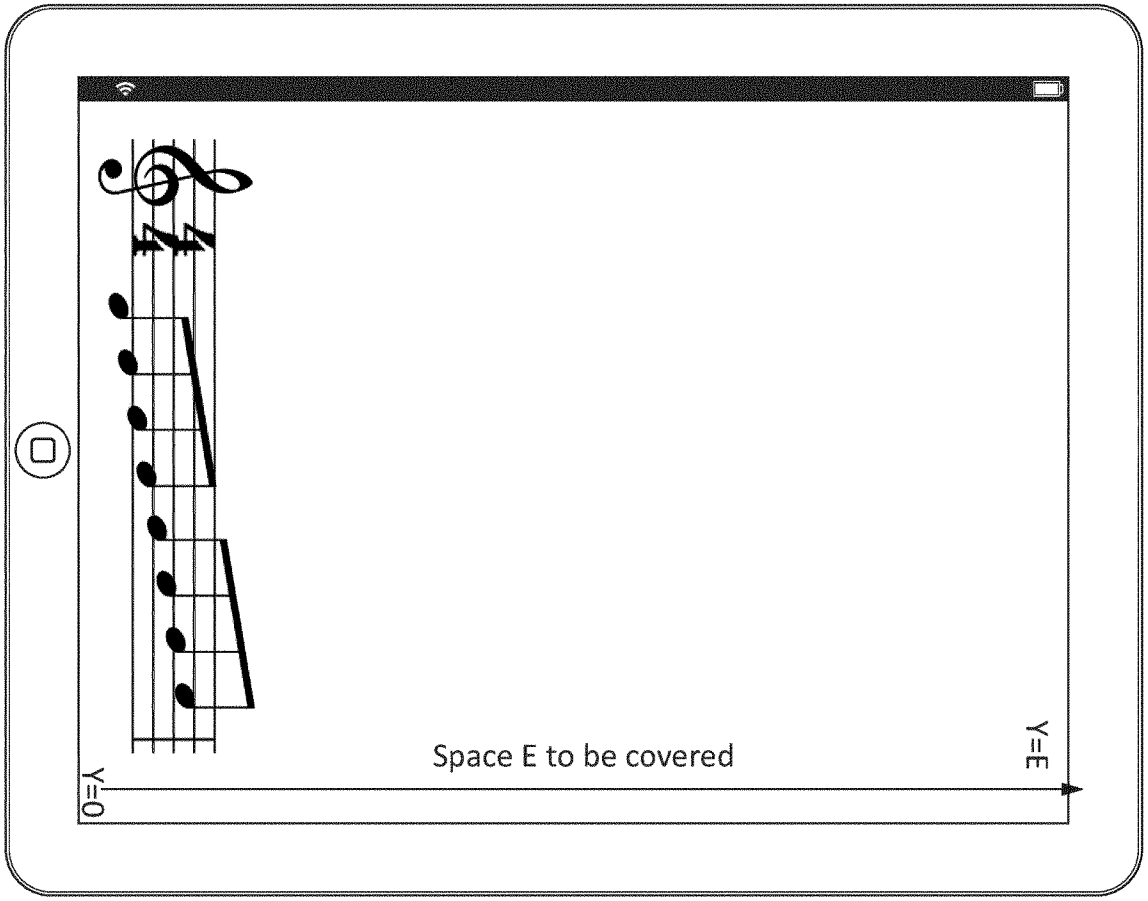
FIG. 2 shows a scheme of vertical scrolling of a measure.
Figure 5A:
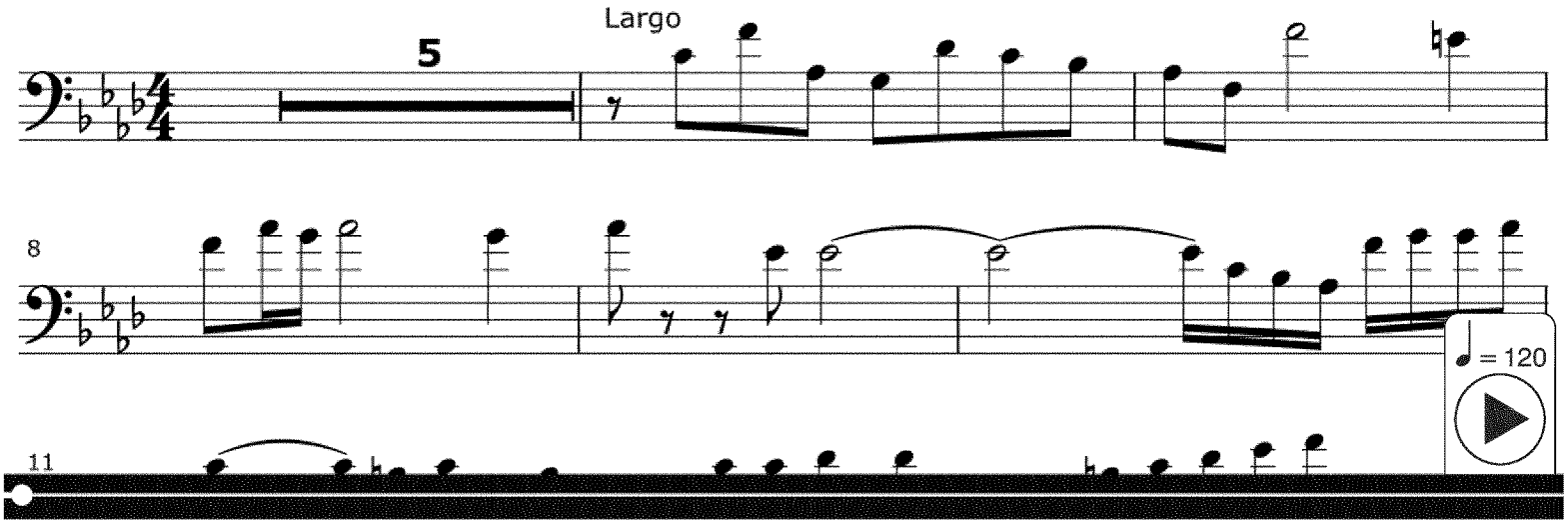
FIGS. 5A to 5D show an example (four sequences) of vertical scrolling, in which the continuity of the scrolling is perfectly appreciated.
Figure 5B:
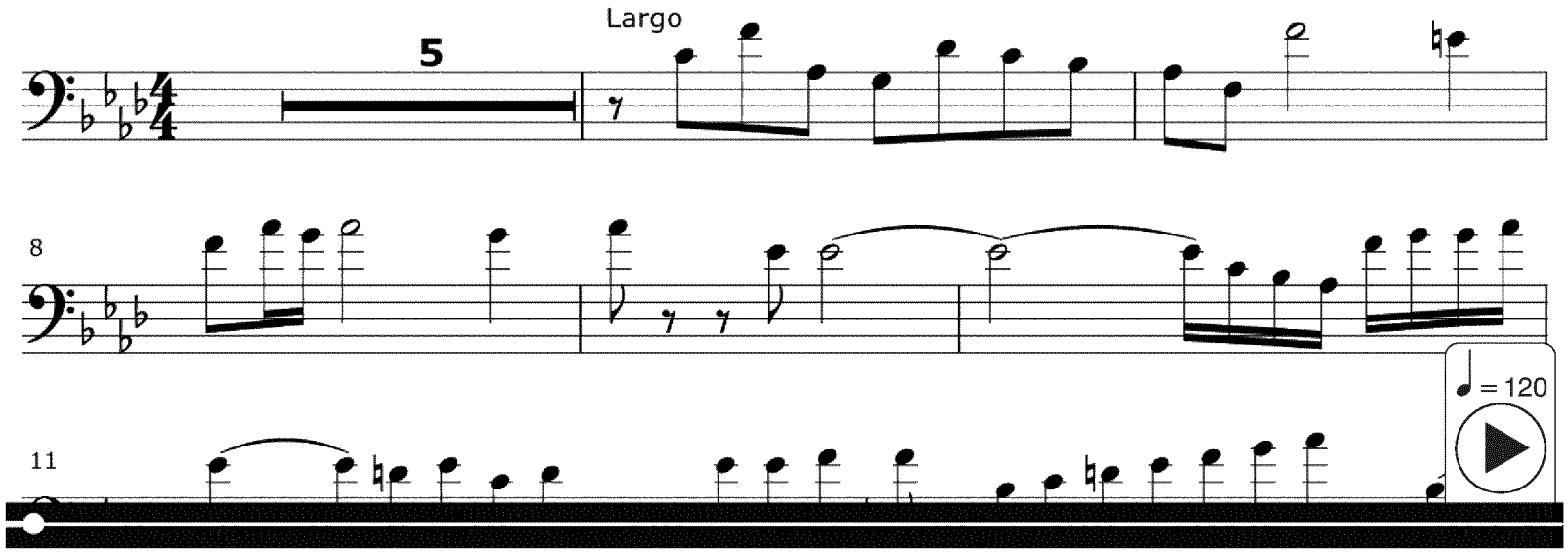
Figure 5C:
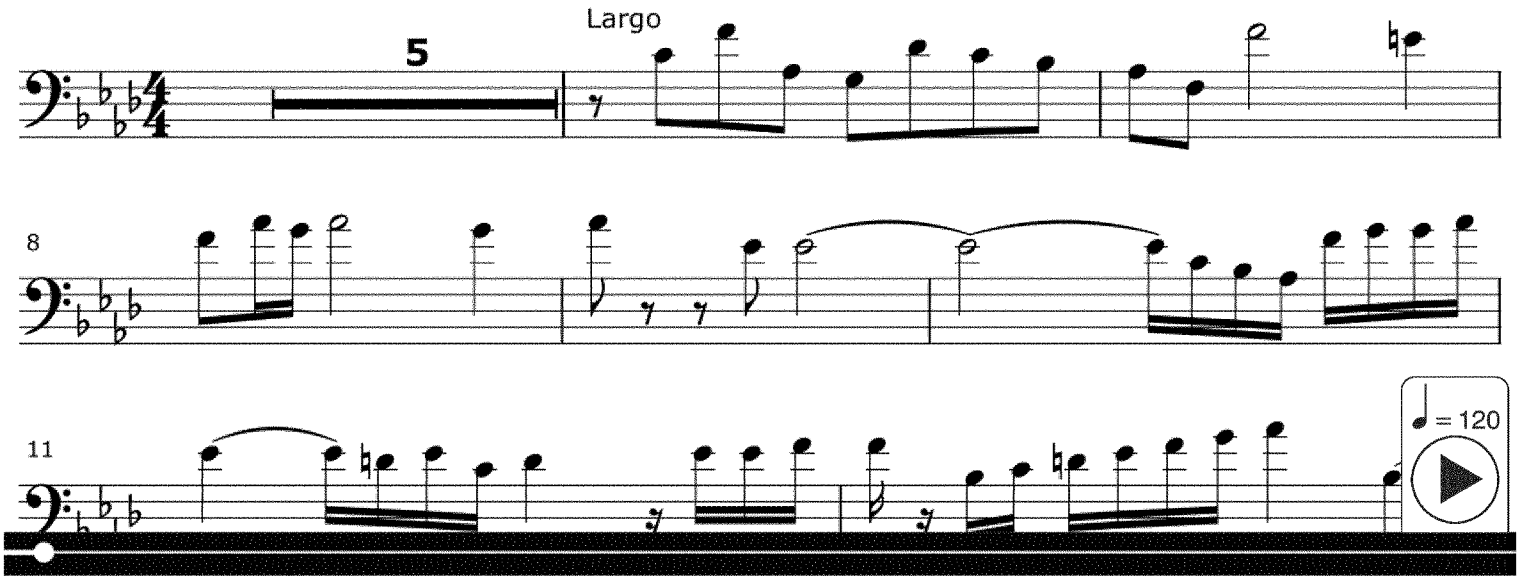
Figure 5D:
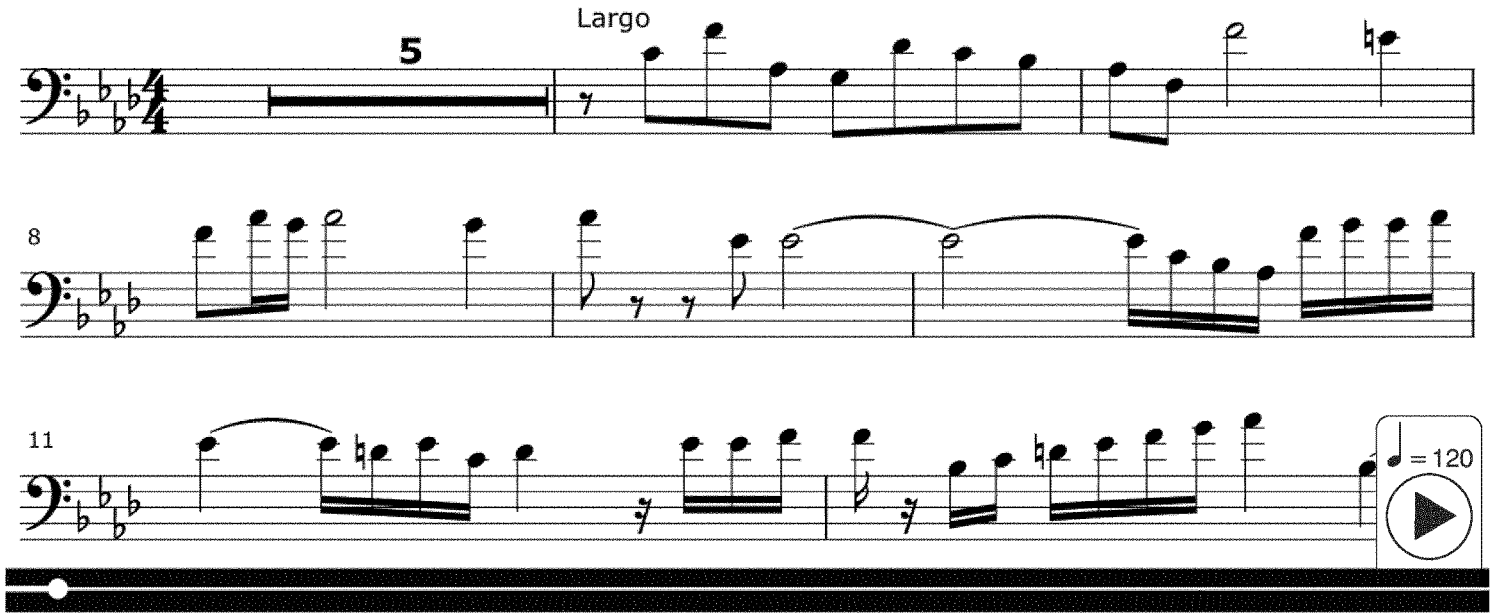
Figure 6A:
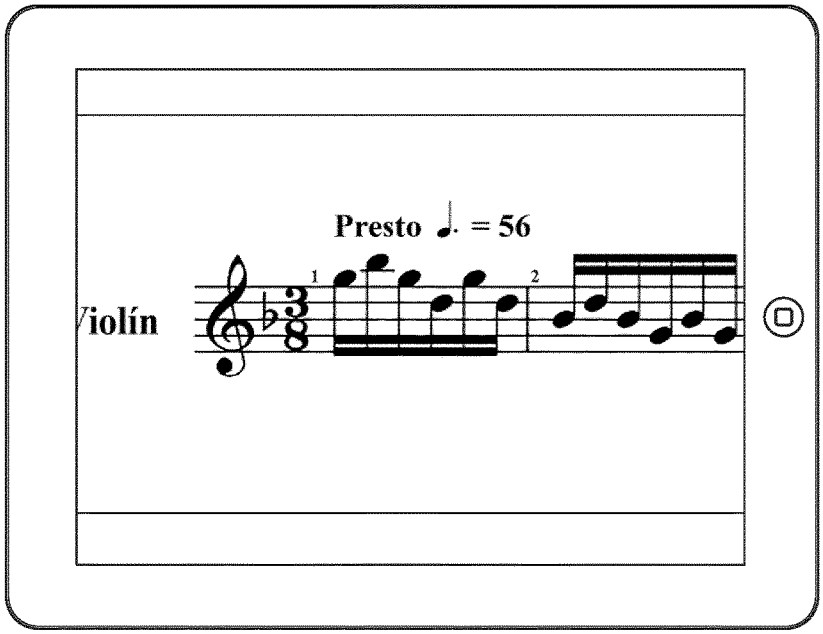
FIGS. 6A to 6E show an example (five sequences) of horizontal scrolling, in which the continuity of the scrolling is perfectly appreciated.
Figure 6B:
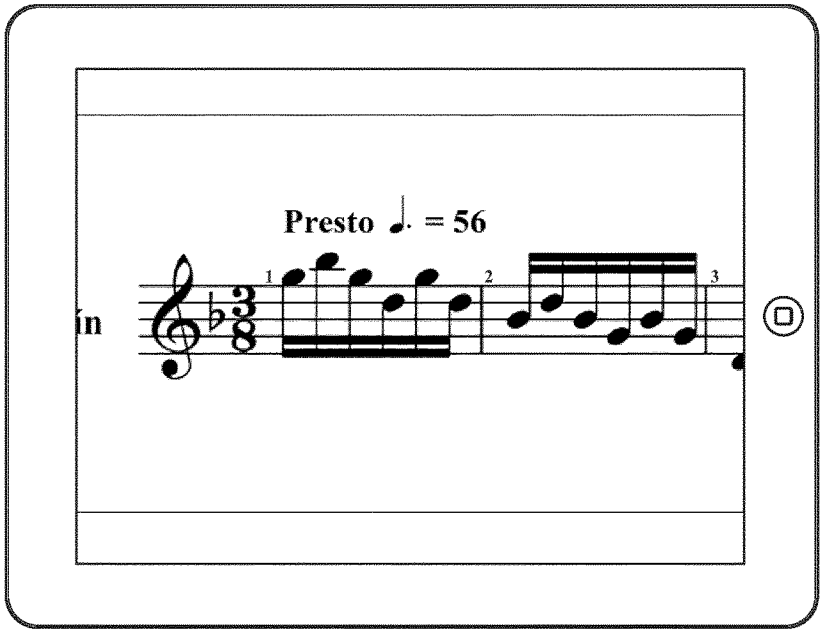
Figure 6C:
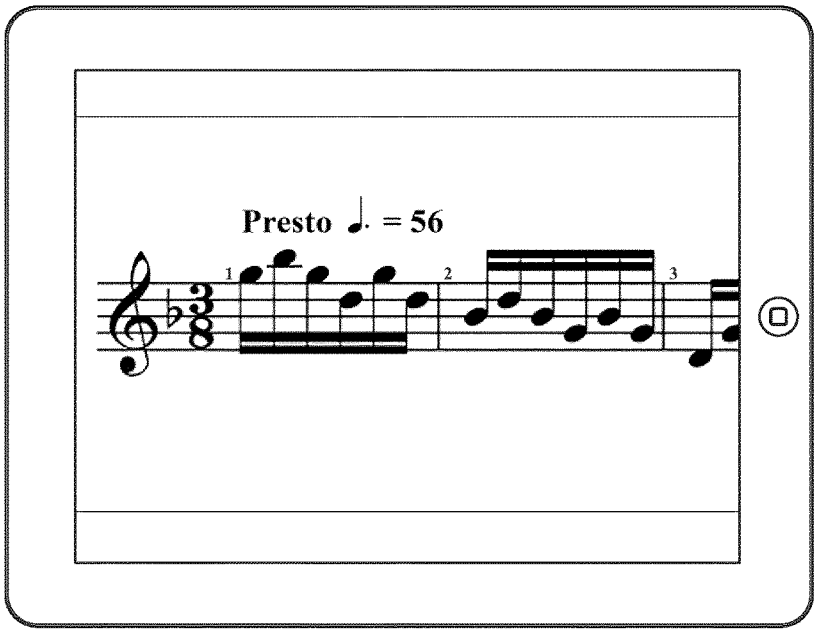
Figure 6D:
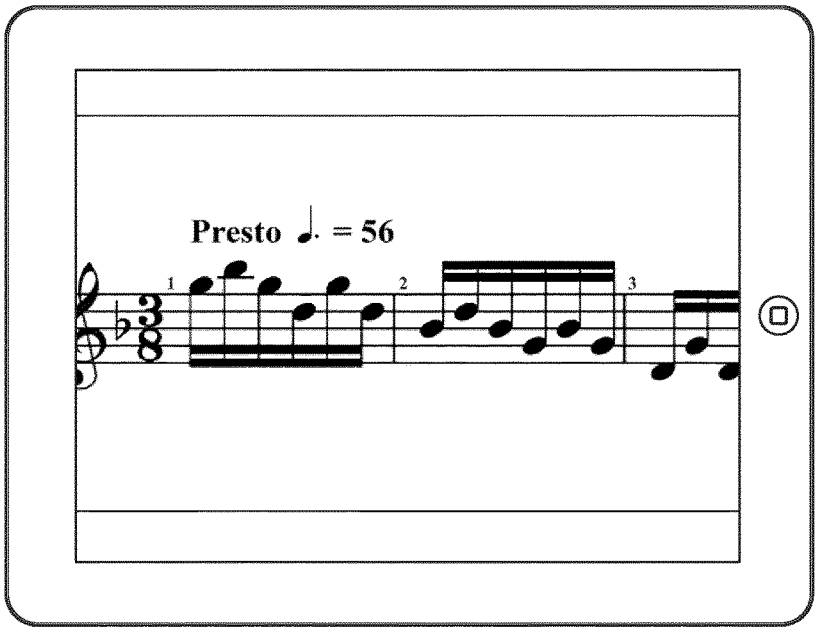
Figure 6E:
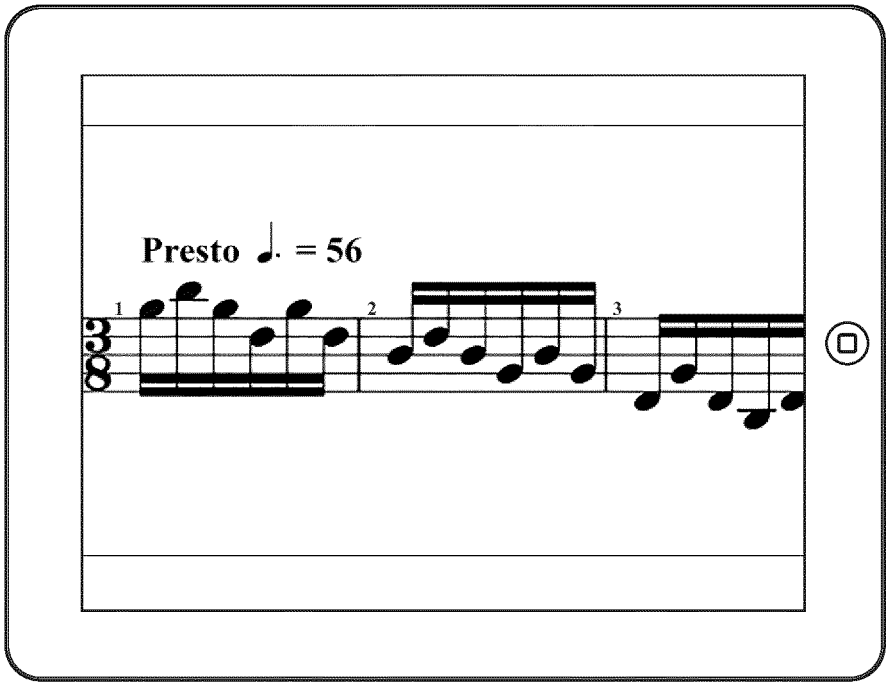

In terms of a single measure the speed can be seen as the amount of space covered by the measure on the screen, divided by the amount of time that a user would need to read or interpret that measure. Similarly, in terms of a single note, the speed can be seen as the amount of space covered by the note on the screen, divided by the amount of time that a user would need to read or interpret that note. FIG. 1 shows a scheme of horizontal scrolling (displacement). FIG. 2 shows a scheme of vertical scrolling. In both cases, the measure starts at a position "0" (X=0 in FIG. 1 and Y=0 in FIG. 2) and covers a certain space E in time T. E represents the space to be covered. E is the width or length of the screen, respectively. The scrolling speed is obtained after dividing E by the time T which is required for playing that measure. The same reasoning applies, mutatis mutandis, if a note is considered instead of a measure. FIGS. 5A to 5D show an example of vertical scrolling, in which the continuity of the scrolling is perfectly appreciated. At a certain time instant, two complete systems of a score are shown and a third system is starting to show up (FIG. 5A). At a next time instant, the score has moved up and a larger amount of the third system is being shown (FIG. 5B). At a still next time instant, the score has moved up more and the third system is being shown almost completely (FIG. 5C). Finally, at a fourth time instant the score has moved up more and a now the third system is shown completely (FIG. 5D). A new system will start to show up in the following time instant.

Next, the speed is calculated in two different ways: First, taking into account the "measures". Second, taking into account the "notes".

Calculation Taking into Account the Measures

In order to calculate the time T, the beat and the tempo must be taken into account. As already mentioned, the number of beats per measure is not a fixed "universal" value: Although the score rules a specific number of beats per measure (expressed on the score with specific coding of the musical language), this can be changed manually by the user.

In sum, the algorithm reads (scans) the content of the score and is able to detect, within the digital file (file in musical notation format) (such as MusicXML, SMF format or MXL), the number of beats that each measure has by default.

Again referring to a single measure, the time T required for playing a measure is obtained by dividing the number of beats of a measure by the specified tempo.

$$T_{measure}=n_beats_{measure}/\text{tempo}$$

For example, a tempo=60 means that there must be 60 beats per minute. Similarly, a tempo=120 means that there must be 120 beats per minute (that is, 2 beats per second).

Thus, if a measure has, for example, 4 beats, and the tempo is 120, then, the time required for playing a measure ($T_{measure}$) is 4 beats/120 beats/minute):

$$T_{measure} = \frac{4\text{ beats}}{\frac{120\text{ beats}}{\text{minute}}} = \frac{1}{30}\text{ minutes} = 2\text{ seconds}$$

As a consequence, the calculation of the speed at which a single measure moves on the screen, is as follows:

First, the dimensions of the screen (length and width) are obtained from the device. With this information, the space E to be covered is obtained.

Second, the number of beats per measure ($n_beats_{measure}$) is obtained from the score file. Alternatively, this is imposed by the user.

Then, the tempo applied to the beats is obtained. Alternatively, this is imposed by the user.

Finally, $T_{measure}=n_beats_{measure}/\text{tempo}$ is the time length that the measure needs to cover space E.

And the speed of the measure is $$V_{measure} = \frac{E}{Tmeasure}$$

Figure 3:
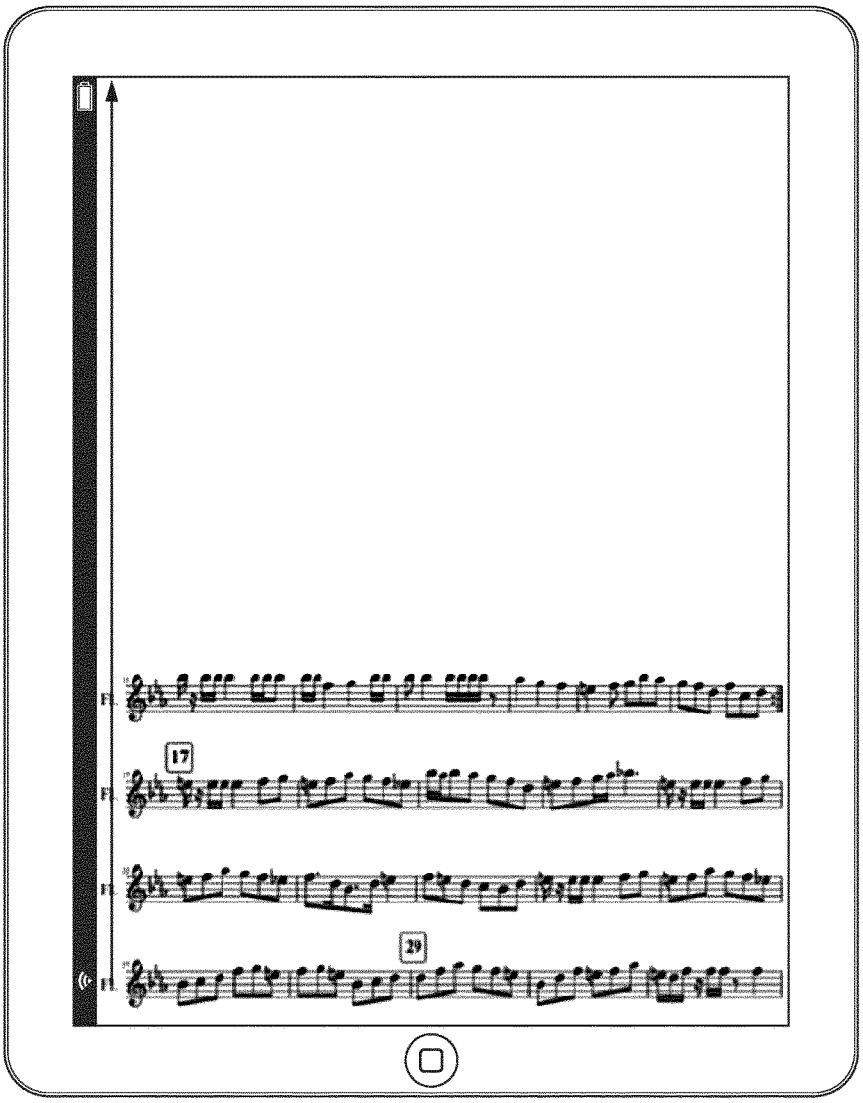
FIG. 3 shows an example of vertical scrolling of a whole score.
Figure 4:
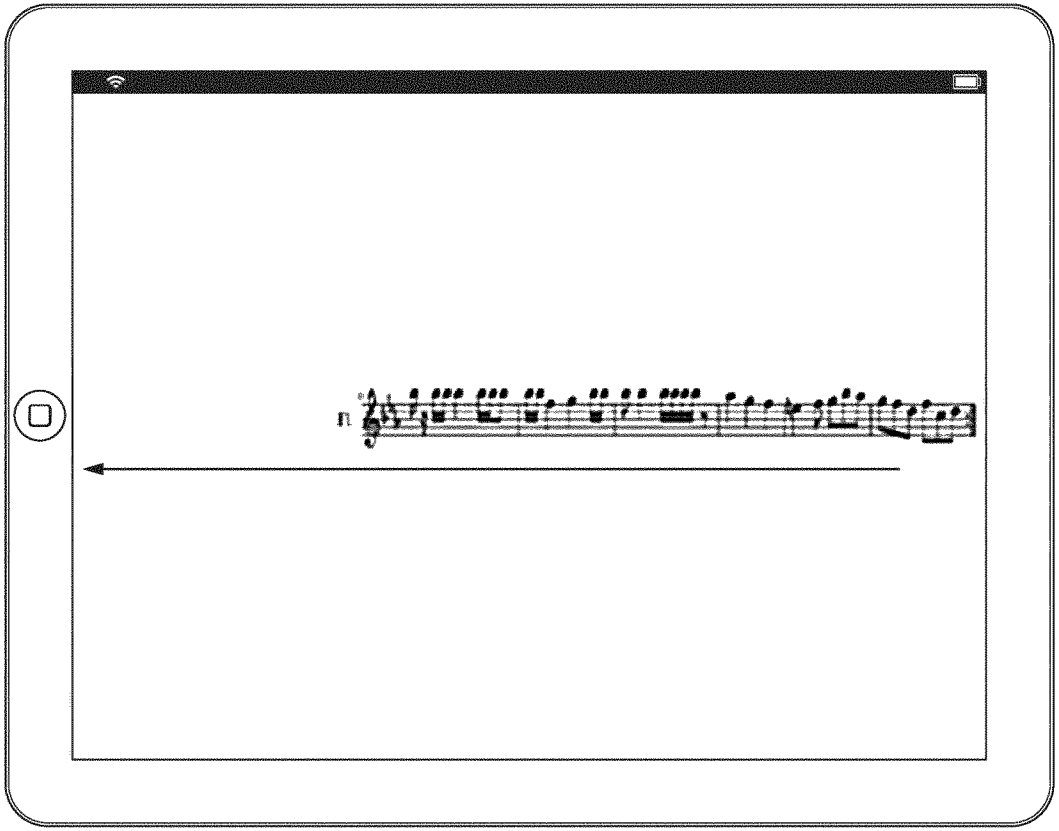
FIG. 4 shows an example of horizontal scrolling of a whole score.

The previous formula represents a very specific situation in which a score is formed by a single measure or for a very specific visualization scale, in which a single measure is shown on the screen. The scrolling speed of a whole score (or rather, of a portion of a score which is at a time displayed on the screen) is explained as follows. Showing several measures on the display is a typical situation, either with vertical or horizontal scrolling, as illustrated in FIGS. 3 and 4.

First, a file having a digital score (a score in a musical notation format) is loaded in a device. As said, the score comprises a plurality of measures. Then, at least one measure from the score is displayed on the screen. If vertical scrolling is used, normally a plurality of measures is displayed on the screen in different lines (staffs, staves or systems), corresponding to the scrolling score. If, however, horizontal scrolling is used, normally less measures are displayed, since there is a single line (staff, system) on the screen. The score is scrolled continuously, by showing on the screen additional measures of music while the already scrolled measures disappear from the screen. The displayed measures move or travel along the line (staff, stave) or score in a dynamic way, according to the tempo, until they disappear when they reach the end of the line (or in general, the end of the screen opposite from the end of the screen from which they had previously started to be shown). As directly derived from the definition of the term "scrolling", the measures do not suddenly show up "complete" on the screen, but they turn up continuously. This means that, in vertical scrolling, a whole line starts to show up, wherein all the measures contained therein are firstly incomplete until the whole line is simultaneously completed. In horizontal scrolling, when a new measure starts to turn up, it is incomplete, the size or length of the measure being increasing while the score scrolls.

The scrolling speed is adjusted according to the displayed measures and to the tempo. The tempo can be selected from the following group of tempos: according to the real-time tempo of the user who is actually playing, according to the tempo indicated in the digital score or, when a group of users are playing together, according to the tempo imposed by one of them. Similarly, the beats (number of beats per measure) can also be selected from the following group of beats: imposed by the user who is actually playing, according to the beats indicated in the digital score or, when a group of users are playing together, imposed by one of them.

In this last case (a group of players) each player has a device which enables to perform the current method of scrolling the musical score on the screen of the devices. All the devices are synchronized to a master one, which is capable of imposing the tempo to be group.

This prompts to an additional difficulty: In vertical scrolling or displacement, in which a musical line (staff, system) scrolls from bottom to top, several lines (staffs, systems) are shown at a time instant, each of said lines (staffs, systems) having several measures (the number of measures per line (staff, system) generally being variable). As a consequence, each line (staff, system) can have a different number of beats. In other words, the number of beats per line (staff, system) is not constant.

It is inadvisable to calculate the scrolling speed per line (staff, system) of music ($v_{line}$), because this would imply that lines (staffs, systems) would move (scroll) at different speeds from each other (considering the general situation in which the number of beats per line (staff, system) was not constant). The score would then be illegible. As a consequence, it is necessary to adjust the scrolling speed of what is being shown on the screen.

Next, the calculation of this adjustment of the scrolling speed in the event of vertical scrolling is explained.

The number of measures shown on the screen must be obtained, in order to estimate the time required to read/play them. In a particular embodiment, an average number of measures per line (staff, system) is estimated, in order to estimate the time required to read/play them.

The time T required for playing the measures which are simultaneously displayed on the screen is estimated according to the following formula:

$$T=\Sigma_{i=1}^{N}T_{measure_i}$$

wherein N is the total number of measures displayed on the screen. N being read from the digital score, and $$T_{measure_i}=n_\text{beats}_{measure_i}/\text{tempo}$$

wherein "tempo" is either the tempo indicated in the digital score or a tempo imposed by the user (or by the conductor) and $\text{n_beats}_{measure_i}$ is the number of beats that the measure number "i" has, said number being either read from the digital score or imposed by the user (or conductor).

A similar estimation is done in the event of horizontal scrolling. The only difference is that, in horizontal scrolling, it is not necessary to calculate the time required to read several measures. In fact, in horizontal scrolling each measure can have a different speed, since depending on their length, each measure might have to cover a different space. This is explained in detail later on.

Then, the dimensions of the screen (length and width) are obtained from the device. Thus, the space be covered by the displayed measures can be calculated. One must take into account that the number of measures which fit in the screen is calculated from the dimensions of the screen and from the scale which the user has applied (this last parameter is a parameter totally controlled by the player). Another requirement is that measures cannot be split in two lines (staves). The system is always adjusted for scaling the measures such that they can be seen in a single line on the screen.

Now, the scrolling speed can be calculated from the estimated time T required for playing the measures displayed on the screen and from the calculated space to be covered by said measures and scrolling the score at said calculated speed:

$$V=\frac{E}{T}$$

This calculation is repeated and the scrolling speed is adjusted every time the screen is refreshed. In fact, only when a whole line (staff, system) disappears from the screen and a complete new line (staff, system) shows up on the screen, the speed is adjusted (except if, of course, a player or conductor imposes any change externally). For example, a user can change the tempo by several taps on the screen of the device, or using pedals or any other system to send signals to the device. The time intervals between two consecutive signals sent are the tempo that the user desires. Similarly, a user can change the number of beats per measure, by acting on the available menu options.

As already mentioned, in a particular embodiment, an average number of measures per line is estimated, in order to estimate the time required to read/play them. This is optional, meaning that the user can choose to calculate this average number of measures per line. In this case, we need to introduce the concept of "line", which we use to generally refer to either a stave or staff ("pentagrama") or a system ("sistema"). Except for the particular exception explained next, a line corresponds to a stave.

That is to say, since each line has generally a different number of measures, an average number of measures is calculated. For example, if there are four lines on the screen, having in total 22 measures, the average number of measures per line is 22/4=5.5 measures per line. In a preferred embodiment, this number is rounded off to the lower number (in this example, to 5). In other words, for practical reasons, an average of the speed of all the lines (systems) shown in the display, is calculated. Besides, whenever a new system (line) is displayed on the screen, the average speed is recalculated for all the current lines on the screen, and its displacement/scrolling is adjusted automatically. After calculating the speed, displacement of the score upwards is processed, by changing the position of each of the system (lines). This is repeated until the last line of the score is drawn on the screen.

So, the screen of the device shows, simultaneously, a plurality of musical lines K. Each of these K lines has at least one measure, but in general can have a number Mk of measures: for example, line 1 has $M_1$ measures, line 2 has $M_2$ measures and line K has $M_K$ measures. In general, the number of measures per line is variable from line to line (in general $M_1 \neq M_2 \ldots \neq M_K$). The scrolling speed is calculated as follows:

First, the time $T_k$ required for playing each musical line shown on the screen is calculated as follows:

$$T_k = \Sigma_{i=1}^{Mk} T_{measure_i}$$

wherein k varies from 1 to K. K being the total number of lines shown on the screen, wherein Mk is the number of measures in line k, and $M_1\ M_2 \ldots M_k \ldots M_K$ are read from the digital score.

Then the total time T required for playing the Mk lines shown on the screen is calculated as follows:

$$T = \Sigma_{k=1}^{K} T_k$$

An average time $T_{av}$ per line is calculated:

$$T_{av} = \frac{T}{K};$$

Optionally it is rounded off to the lower natural number. This option can be selected by the user.

Finally, the scrolling speed is calculated from the estimated time $T_{av}$ required for playing the measures displayed on the screen and from the calculated space to be covered by the measures. The score is then scrolled at the calculated speed.

This calculation and adjustment of the scrolling is repeated every time the screen is refreshed or updated, that is to say, every time the first line disappears and a new one shows up at the bottom of the screen. This refreshing is done pixel by pixel or every certain amount of pixels, at a high speed, similar to cinema frames, giving a total impression of continuous scrolling.

In an alternative embodiment, the score scrolls horizontally instead of vertically. This implies that there is one single line of music. In this situation, the complexity in the calculation is based on the generally different size (in particular, length) of each measure, taking into account that they all have the same number of beats, so that the time length is the same for them all.

In this embodiment, the calculation of the scrolling speed is done by taking into account the last measure shown on the screen or, more precisely, taking into account every new measure that shows up on the screen (first a small piece of the measure turns up and the measure "grows" while the score scrolls).

So, every time a measure i starts to be displayed on the screen, the time T required for playing the measure is estimated as follows:

$$T_{measure_i} = n_\text{beats}_{measure_i}/\text{tempo}$$

wherein "tempo" is either the tempo indicated in the digital score or a tempo imposed by the user (or conductor) and $n_\text{beats}_{measure_i}$ is the number of beats that the measure number "i" has, this number being either read from the digital score or imposed by the user or conductor.

Next, the length of the screen is obtained from the device, thus calculating the space to be covered by the measure i. Also, from the digital score the length of the current measure i is read. This is done because the file is in a digital format and a mark identifying the start and end of measures is present in the digital file.

The sum of the space to be covered by the measure and the length of the measure is obtained: E=space to be covered by the measure+length of measure.

Finally, this sum is divided by the estimated time T required for playing the measure.

The score can then be scrolled at that calculated speed.

This is recalculated every time the screen is refreshed. In particular, every time a new measure "i+1" turns up on the screen.

Calculation Taking into Account the Notes

As has been said, in terms of notes, the speed can be seen as the amount of space covered by one note on the screen, divided by the amount of time T that a user would need to read or interpret that note. In order to calculate the time T, the tempo must be taken into account. The tempo is expressed as a "reference figure"="value", wherein the "value" represents how many times that "reference figure" (or any equivalent ones) must be played in one minute. This means that knowing the tempo and a note, the amount of time T required to interpret that note is calculated as follows:

$$T_{note} = (\text{amount of reference figures in that note})/\text{tempo value}$$

By default this time $T_{note}$ is expressed in minutes (like the tempo). By multiplying by 60, the $T_{note}$ is expressed in seconds.

For example, if the tempo is indicated as "eighth note=50" and the note to be played is a whole note, then the amount of time T required to interpret that whole note is calculated as follows:

$$T_{whole\ note} = (8\ \text{eighth notes/whole note})/50 = 0.16\ \text{minutes} = 9.6\ \text{seconds}$$

In sum, the algorithm reads (scans) the content of the score and is able to detect, within the digital file (file in musical notation format) (such as MusicXML or SMF format), the individual notes to be played and the amount of time required for playing those notes.

As a consequence, the calculation of the speed at which a single note moves on the screen, is as follows:

First, the dimensions of the screen (length and width) are obtained from the device. With this information, the space E to be covered is obtained.

Second, the amount of time T required to interpret that note is calculated (as already explained). $T_{note}$ is the time length that the note needs to cover space E.

And the speed of the note is $$V_{note} = \frac{E}{Tnote}$$

The previous formula represents a very specific situation in which a single note is shown on the screen (for example for a very specific visualization scale, such as for enabling a visually-impaired person to read music). The scrolling speed of a whole score (or rather, of a portion of a score which is at a time displayed on the screen) is explained as follows. Showing several notes on the display is a typical situation, either with vertical or horizontal scrolling, as illustrated in FIGS. 6A to 6E, in which the continuity of the horizontal scrolling is perfectly appreciated.

First, a file having a digital score (a score in a musical notation format) is loaded in a device. As said, the score comprises a plurality of notes. Then, most frequently a plurality of notes from the score is simultaneously displayed on the screen. If vertical scrolling is used, normally a plurality of notes is displayed on the screen in different lines (staves (staffs) or systems), corresponding to the scrolling score. If, horizontal scrolling is used, also a plurality of notes is displayed in a single line (staff or system) on the screen. The score is scrolled continuously, that is to say, pixel by pixel or in sets of several pixels, by showing on the screen additional notes of music while the already scrolled notes disappear from the screen. In other words, the notes are not static on the screen (as would be if a page-by-page or slide-by-slide scrolling was used), but they continuously scroll, move, travel or slide from right to left (in horizontal scrolling) or from bottom to top (in vertical scrolling) at a speed calculated by the system from the tempo. As directly derived from the definition of the term "scrolling", the notes do not suddenly show up "complete" on the screen, but they turn up continuously. This means that, in vertical scrolling, a whole line (system, staff) starts to show up, wherein all the notes contained therein are firstly incomplete until the whole line (system, staff) is simultaneously completed. In other words, a system (line, stave) and its notes go up gradually upwards the screen, until they disappear at the upper end of the device. In a preferred embodiment music travels from bottom to top, but it could alternatively travel from top to bottom. In horizontal scrolling, when a new note starts to turn up, it is incomplete, the size or length of the note being increasing while the score scrolls. In other words, notes travel gradually from right to left on the screen, until they gradually disappear at the left end of the device. In a preferred embodiment music travels from right to left, but it could alternatively travel from left to right.

The scrolling speed is adjusted according to the displayed notes and to the tempo. The tempo can be selected from the following group of tempos: according to the real-time tempo of the user who is actually playing, according to the tempo indicated in the digital score (reference figure=value) or, when a group of users are playing together, according to the tempo imposed by one of them.

In this last case (a group of players) each player has a device which enables to perform the current method of scrolling the musical score on the screen of the devices. All the devices are synchronized to a master one, which is capable of imposing the tempo to the group.

This prompts to an additional difficulty: In vertical scrolling or displacement, in which a musical line (staff, system) scrolls from bottom to top, several lines (staffs, systems) are shown at a time instant, each of said lines (staffs, systems) having several notes (the number of notes per line generally being variable). As a consequence, each line (staff, system) can have a different number of reference figures. In other words, the number of reference figures per line (staff, system) is not constant.

It is inadvisable to calculate the scrolling speed per line of music ($v_{line}$), because this would imply that lines would move (scroll) at different speeds from each other (considering the general situation in which the number of reference figures per line (staff, system) was not constant). The score would then be illegible. As a consequence, it is necessary to adjust the scrolling speed of what is being shown on the screen.

Next, the calculation of this adjustment of the scrolling speed, which fits both in the event of vertical scrolling and in horizontal scrolling, is explained.

The number of notes shown on the screen at every time instant must be obtained, in order to estimate the time required to read/play them. In the event of vertical scrolling, in a particular embodiment, an average number of notes per line (staff, system) is estimated, in order to estimate the time required to read/play them.

The time T required for playing the notes which are simultaneously displayed on the screen is estimated according to the following formula:

$$T=\Sigma_{i=1}^{N}T_{note_i}$$

wherein N is the total number of notes displayed on the screen, N being read from the digital score, and $$T_{note_i}=\text{(amount of reference figures in the note)}/\text{tempo value}$$

wherein "tempo" represents a "reference figure=value" and is either the tempo indicated in the digital score or a tempo imposed by the user (or by the conductor).

In a polyphonic score, for example for a guitar, in which different notes are played simultaneously, those notes which are played simultaneously due for example to the nature of the instrument, are not summed up (just because they must be played simultaneously). On the contrary, one single note representative of each group of simultaneous notes is considered in the sum for calculating T. In a preferred embodiment, a representative note according to the melodic lines is considered. In other words, in general, N is the total number of notes displayed on the screen to be played sequentially.

A similar estimation is done in the event of horizontal scrolling. In this embodiment, the calculation of the scrolling speed is done by taking into account every new note that shows up on the screen (first a small piece of the note turns up and the note "grows" while the score scrolls).

Then, the dimensions of the screen (length and width) are obtained from the device. Thus, the space to be covered by the displayed notes can be calculated. One must take into account that the number of notes which fit in the screen is calculated from the dimensions of the screen and from the scale which the user has applied (this last parameter is a parameter totally controlled by the player). Another requirement is that notes cannot be split in two lines (staffs, staves, systems). The notes are always adjusted (scaled) such that they can be seen in a single line (staff, system) on the screen.

Now, the scrolling speed can be calculated from the estimated time T required for playing the notes displayed on the screen and from the calculated space to be covered by said notes and scrolling the score at said calculated speed:

$$V=\frac{E}{T}$$

This calculation is repeated and the scrolling speed is adjusted every time the screen is refreshed (pixel by pixel or in groups of pixels). In fact, in vertical scrolling, only when a whole line (staff, system) disappears from the screen and a complete new line (staff, system) shows up on the screen, the speed is adjusted (except if, of course, a player or conductor imposes any change externally). For example, a user can change the tempo by several taps on the screen of the device, or using pedals or any other system to send signals to the device. The time intervals between two consecutive signals sent are the tempo that the user desires. In horizontal scrolling the speed is recalculated every time a new complete note is first shown on the screen (on the right side of the screen).

As already mentioned, in vertical scrolling, in a particular embodiment, an average number of notes per line is estimated, in order to estimate the time required to read/play them. This is optional and can be selected by the user. In this case, we need to introduce the concept of "line", which we use to generally refer to either a stave (or staff) ("pentagrama") or a system ("sistema"). Except for the particular exception explained next, a line corresponds to a stave (staff).

That is to say, since each line has generally a different number of notes, each of them representing a certain number of reference figures, an average number of reference figures (taking the tempo into account) can be calculated. For example, if there are four lines on the screen, having in total 40 notes, and in particular 150 reference figures the average number of reference figures per line is 150/4=37.5 reference figures per line. This number can be rounded off to the lower number (in this example, to 37) or the upper number (in this example, to 38). In other words, for practical reasons, an average of the speed of all the lines (systems, staffs) shown in the display, is calculated. Besides, whenever a new system (line, staff) is displayed on the screen, the average speed is recalculated for all the current lines (systems, staffs) on the screen, and its displacement/scrolling is adjusted automatically. After calculating the speed, displacement of the score upwards is processed, by changing the position of each of the system (lines, staffs) as smoothly as possible (as smoothly as technology permits in order to achieve a precise movement). This is repeated until the last line of the score is drawn on the screen.

So, in vertical scrolling, the screen of the device shows, simultaneously, a plurality of musical lines K. Each of these K lines has in general a number Nk of notes: for example, line 1 has $N_1$ notes, line 2 has $N_2$ notes and line K has $N_K$ notes. In general, the number of notes per line is variable from line to line (in general $N_1 \neq N_2 \ldots \neq N_K$). The scrolling speed is calculated as follows:

First, the time $T_k$ required for playing each musical line shown on the screen is calculated as follows:

$$T_k = \Sigma_{i=1}^{Nk} T_{note_i}$$

wherein k varies from 1 to K, K being the total number of lines shown on the screen, wherein Nk is the number of notes in line k, and $N_1\ N_2 \ldots N_k \ldots N_K$ are read from the digital score.

Then the total time T required for playing the Mk lines shown on the screen is calculated as follows:

$$T = \Sigma_{k=1}^{K} T_k$$

An average time $T_{av}$ per line is calculated:

$$T_{av} = \frac{T}{K};$$

Finally, the scrolling speed is calculated from the estimated time $T_{av}$ required for playing the notes (or equivalent reference figures) displayed on the screen and from the calculated space to be covered by the notes. The score is then scrolled at the calculated speed.

This calculation and adjustment of the scrolling is repeated every time the screen is refreshed or updated, that is to say, every time the first line disappears and a new one shows up at the bottom of the screen.

The space to be covered by the notes shown on the screen is obtained: E=space to be covered by the displayed notes. In vertical scrolling the space E is the length of the screen. In horizontal scrolling the space E is the width of the screen.

Finally, this space E is divided by the estimated time T required for playing the notes on the screen The score can then be scrolled at that calculated speed.

This is recalculated every time the screen is refreshed. In particular, every time a new note "i+1" turns up on the screen.

Figure 7:
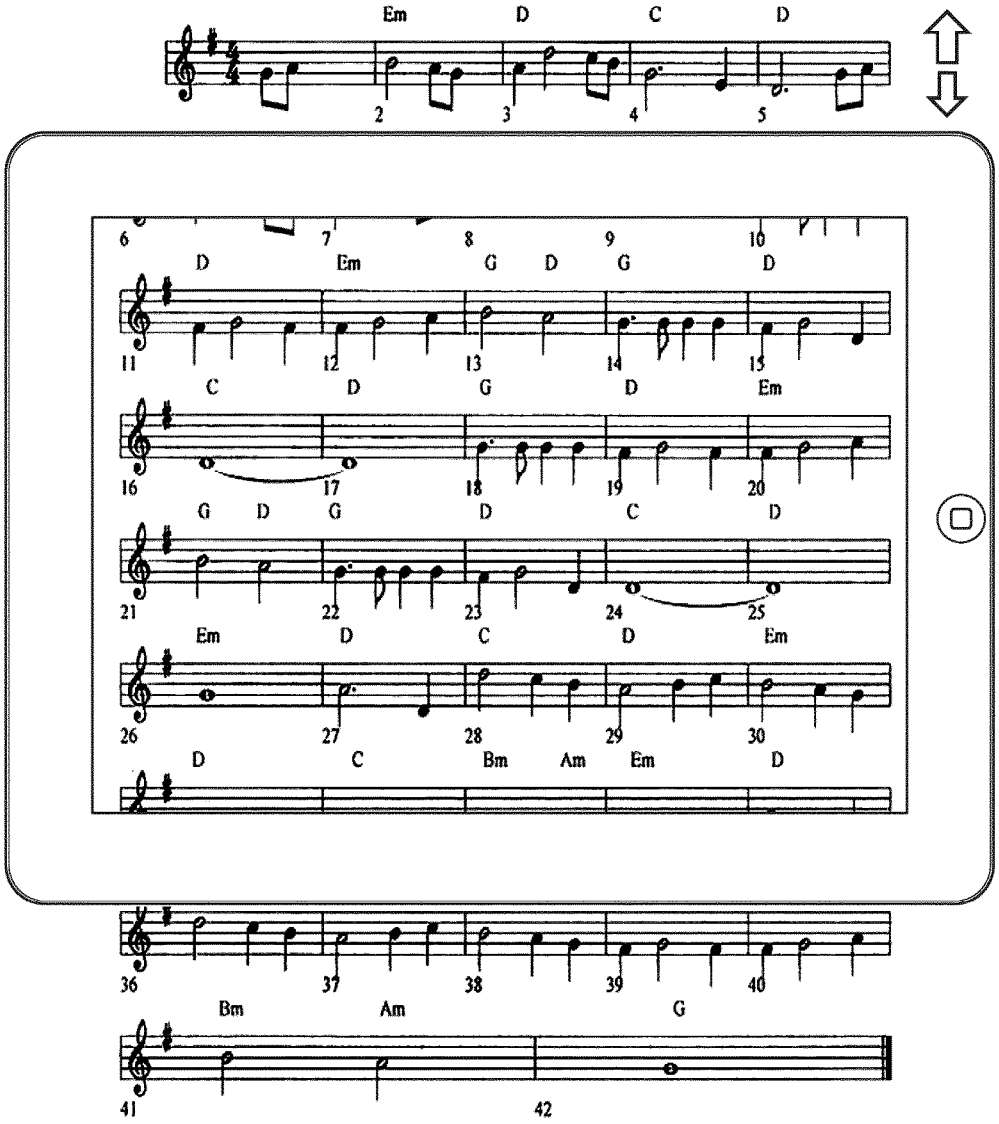
FIG. 7 shows a virtual representation of the continuous scrolling of the invention, which is clearly different from a conventional page-by-page scrolling.

The method provides an additional advantage, which is the elimination of the concept of "page" in a score, which results in the score being a continuous string of musical signs, similar to an infinite paper roll, thus permitting the musician to read both the notes not already played and the notes already played, as a consequence of which more flexibility and expressivity in the performance is obtained. Using a digital format (musical notation format), such as the MusicXML or the SMF format or MXL, all the musical notes are drawn on the screen in a consecutive and dynamic way, forgetting the groups "page by page". FIG. 7 shows a virtual representation of the continuous scrolling of the invention, which is clearly different from a conventional page-by-page scrolling. Unlike in conventional page-by-page scrolling (or slide-by-slide scrolling), in which the notes or measures are shown in a specific, static location on the display until a new page or slide replaces the former one, the scrolling method of the present invention permits the movement of the notes or measures along the screen (either from bottom to top or from right to left). In other words, the musical symbols are drawn on the screen in the same way as they would turn up on a page, but simulating a single infinite page which dynamically rolls or unrolls, provoking the physical displacement of the notes or measures. In order to achieve this, the dimensions of the screen of the device are detected. Preferably also the orientation of the screen is detected. In a particular embodiment, the different modes of visualization are also detected: either grouped by systems (or lines) or as a single line of measures (or notes).

The size of the musical signs is calculated and they are adjusted to the dimensions of the screen. Besides, a buffer having the required size is created, so that a linear representation of the music contained in the digital file (file in musical notation format) is possible. In order to correctly visualize the score, the content of the digital file (such as MusicXML, SMF or MXL) is adjusted to the width of the screen. The musical signs are always scaled by adjusting them to the width of the screen. However, a condition that must always be achieved is that at least one whole measure or a certain number of notes must be simultaneously (at a certain time instant) seen (drawn) on the screen.

Additionally, the method can be carried out by a plurality of users playing simultaneously the same score. In that case, each user has a device of the ones already described (at least with a processor, memory and screen), the digital score being shown in a device of each user. In this case, one of the devices can work as a master one, in the sense that its user can impose the tempo or beats used when playing the score. In this case, the remaining devices are synchronized to the master one. The remaining devices, however, keep the possibility of scaling the screen according to their needs (for example, visual needs) and, as a consequence, of controlling the scrolling speed of their devices.

As already mentioned along this text, upon completion of loading the digital file in a piece of memory of the device, the user can interact with the application, imposing his/her preferences in relation to several aspects. For example, the score can be read by externally imposing the scrolling speed, such as, but not limited to, touching the screen with the fingers, using a stylus or any other device, or through pedals controlled with the feet, thus allowing hands-free operation. In a particular example, one pedal controls the tempo, while another one controls the auto-scrolling. Pedal can also be used to increase/decrease scrolling speed. Sometimes, a wireless connection, such as Bluetooth or wifi, is required. Also, annotations on the score can be made and shared.

When playing an instrument, the automatic scroll (the option based on the annotations on the digital file) is preferably started by default, but at any moment its control can be switched from automatic one to external one (controlled by a user). Automatic scrolling can also be paused. Also the display scale can be externally adjusted to adapt to the user preferences (depending, for example, on the instrument the user is playing, which might oblige the user to stay closer to or farther from the screen). When the user selects a new value of scale, the content of the score is recalculated in the buffer, adapting said content to the new size. Subsequently, the content stored in the buffer is redrawn on the screen.

The tempo at which the automatic scrolling runs, can also be changed (imposed externally) without giving up automatic scrolling. The tempo of the score, which affects the speed of automatic scrolling, can be changed (by a user) in two ways: (1) by selecting a particular value (via an interface with the device, such as its screen or keyword) or (2) marking it by making periodic pulsations. This second possibility emulates what musicians usually do, which is to keep pace, using their hands or feet. So, a first tap is detected and it is waited for a second tap. The time between two consecutive taps represents the selected tempo. Taps can be made manually directly on the screen of the device, through pedals, using the user's feet, or by any other means.

The user (musician or conductor) can also change the number of beats per measure (which are predefined in the digital score) by externally selecting a certain value, for example via an interface with the device, such as its screen or keyword.

Concerning the scores, they can be stored either in the device itself (locally) or in an external site in the Internet (cloud). In this last case, the user normally accesses this restricted are via identity name and password.

The software application also permits the user to purchase scores. Preferably, once a score as been purchased, it is stored in an external system restricted to a particular classification of metadata.

On the other hand, the invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

The invention claimed is:

1. A method for scrolling a musical score on a screen of a device, comprising:

loading a file having a digital score in a part of memory of said device, wherein said digital score is in a digital format for representing musical notation;

displaying a plurality of notes from said score on the screen;

the method being characterized in that it further comprises:

scrolling said score in a continuous way by moving the notes displayed on the screen, in such a way that additional notes of music start to gradually appear on the screen while the already scrolled notes start to gradually disappear from the screen;

repeatedly adjusting the scrolling speed according to the notes being displayed on the screen of the device and to a tempo, wherein said tempo comprises a reference musical figure with respect to which said displayed notes can be represented and a value indicating the amount of reference musical figures to be played per time unit.

2. The method of claim 1, wherein the scrolling speed is calculated as follows:

estimating the time T required for playing the notes displayed on the screen at a certain time instant according to the following formula:

$$T=\Sigma_{i=1}^{N}T_{note_i}$$

wherein N is the total number of notes displayed on the screen to be played sequentially, N being read from the digital score, and $$T_{note_i}=(\text{amount of reference musical figures in note_}i)/\text{tempo value}$$

obtaining from the device the dimensions of the screen, thus calculating the space to be covered by those displayed notes;

calculating the scrolling speed from said estimated time T required for playing the displayed notes and from said calculated space to be covered by said notes and continuously scrolling the score at said calculated speed;

repeating said calculation and adjusting the scrolling speed every time at least one new note appears on the screen.

3. The method of claim 1, wherein the digital score is scrolled either vertically or horizontally, wherein when vertical scroll is used, the displayed notes are moved from bottom to top on the screen and wherein when horizontal scroll is used, the displayed notes are moved from right to left on the screen.

4. The method of claim 1, wherein said tempo is selected from the following group of tempos: according to the real-time tempo of the user who is actually playing, according to the tempo indicated in the digital score or, when a group of users are playing together, according to the tempo imposed by one of them.

5. The method of claim 1, further comprising, after loading the file having a digital score in a part of memory of the device and before starting to scroll the digital score:

identifying in the digital score at least one mark which indicates the repetition of one block of music;

copying said block to be repeated;

pasting in the file as many repetitions as indicated by said at least one mark, in a concatenated way, thus allowing the user to play the music in a linear way, avoiding the need of going back in the digital score.

6. The method of claim 1, which can be carried out by a plurality of users playing simultaneously the same score, the digital score being shown in a device of each user.

7. The method of claim 1, wherein said digital score is in the musicXML format or in the Standard MIDI File (SMF) format or in the MXL format.

8. A device comprising means for carrying out the method according to claim 1, said device being a personal digital assistant (PDA), a portable reader device, a tablet, a cell phone or any device which comprises a memory, a processor and a screen or display.

9. A computer program product comprising computer program instructions/code for performing the method according to claim 1.

10. A computer-readable memory/medium that stores program instructions/code for performing the method according to claim 1.

11. A method for scrolling a musical score on a screen of a device, comprising:

loading a file having a digital score in a part of memory of said device, said score comprising a plurality of measures;

displaying a at least one measure from said score on the screen;

the method being characterized in that it further comprises:

scrolling said score in a continuous way by showing on the screen additional measures of music while the already scrolled measures disappear from the screen;

repeatedly adjusting the scrolling speed according to the measures displayed on the screen of the device, to a tempo and to a number of beats per measure, said tempo being selected from the following group of tempos: according to the real-time tempo of the user who is actually playing, according to the tempo indicated in the digital score or, when a group of users are playing together, according to the tempo imposed by one of them; and said number of beats per measure being selected from the following group: according to the number of beats per measure imposed by the user who is actually playing, according to the number of beats per measure indicated in the digital score or, when a group of users are playing together, according to the number of beats per measure imposed by one of them.

12. The method of claim 11, wherein the digital score is scrolled vertically, the scrolling speed being calculated as follows:

estimating the time T required for playing said at least one measure according to the following formula:

$$T=\Sigma_{i=1}^{N}T_{measure_i}$$

wherein N is the total number of measures displayed on the screen, N being read from the digital score, and $$T_{measure_i}=n_\text{beats}_{measure_i}/\text{tempo}$$

wherein "tempo" is either the tempo indicated in the digital score or a tempo imposed by the user and $n_\text{beats}_{measure_i}$ is the number of beats that the measure number "i" has, said number being either read from the digital score or imposed by the user;

obtaining from the device the dimensions of the screen, thus calculating the space to be covered by said at least one measure;

calculating the scrolling speed from said estimated time T required for playing the measures displayed on the screen and from said calculated space to be covered by said measures and scrolling the score at said calculated speed;

repeating said calculation and adjusting the scrolling speed every time the screen is refreshed.

13. The method of claim 12, wherein a plurality of musical lines K is shown on the screen, each of said lines having at least one measure Mk, said number of measures per line being variable from line to line, the scrolling speed being calculated as follows:

estimating the time $T_k$ required for playing each musical line shown on the screen as follows:

$$T_k=\Sigma_{i=1}^{Mk}T_{measure_i}$$

wherein k varies from 1 to K, K being the total number of lines shown on the screen, wherein Mk is the number of measures in line k, and $M_1$ $M_2$ . . . $M_k$ . . . $M_k$ being read from the digital score, calculating the total time T required for playing the Mk lines shown on the screen as follows:

$$T=\Sigma_{k=1}^{K}T_k$$

calculating an average time $T_{av}$ per line:

$$T_{av}=\frac{T}{K};$$

rounding off said $T_{av}$ to the lower natural number;

calculating the scrolling speed from said estimated time $T_{av}$ required for playing the measures displayed on the screen and from said calculated space to be covered by said measures and scrolling the score at said calculated speed;

repeating said calculation and adjusting the scrolling speed every time the screen is refreshed.

14. The method of claim 11, wherein the digital score is scrolled horizontally, the scrolling speed being calculated as follows:

every time a measure i starts to be displayed on the screen:

estimating the time T required for playing said measure as follows:

$$T_{measure_i}=n_\text{beats}_{measure_i}/\text{tempo}$$

wherein "tempo" is either the tempo indicated in the digital score or a tempo imposed by the user and $n_\text{beats}_{measure_i}$ is the number of beats that the measure number "i" has, said number being either read from the digital score or imposed by the user;

obtaining from the device the length of the screen, thus calculating the space to be covered by said measure i;

reading from the digital score the length of said measure i;

calculating the scrolling speed by dividing the sum of the space to be covered by said measure and the length of said measure, by said estimated time T required for playing said measure;

and scrolling the score in a continuous way at said calculated speed.

15. The method of claim 11, further comprising, after loading the file having a digital score in a part of memory of the device and before starting to scroll the digital score:

identifying in the digital score at least one mark which indicates the repetition of one block of music;

copying the block to be repeated; and pasting in the file as many repetitions as indicated by said at least one mark, in a concatenated way, thus allowing the user to play the music in a linear way, avoiding the need of going back in the digital score.

16. The method of claim 11, which can be carried out by a plurality of users playing simultaneously the same score, the digital score being shown in a device of each user.

17. The method of claim 11, wherein said digital score is in the musicXML format or in the Standard MIDI File (SMF) format or in the MXL format.

18. A device comprising means for carrying out the method according to claim 11, said device being a personal digital assistant (PDA), a portable reader device, a tablet, a cell phone or any device which comprises a memory, a processor and a screen or display.

19. A computer program product comprising computer program instructions/code for performing the method according to claim 11.

20. A computer-readable memory/medium that stores program instructions/code for performing the method according to claim 11.

21. A method for scrolling a musical score on a screen of a device, comprising:

loading a file having digital score in part of memory of the device, wherein the digital score is in a digital format for representing musical notation;

displaying a plurality of notes from the score on the screen;

scrolling the score by moving the notes displayed on the screen, in such a way that additional notes of music start to gradually appear on the screen while the already scrolled notes start to gradually disappear from the screen;

repeatedly adjusting the scrolling speed according to the notes being displayed on the screen of the device and to a tempo, wherein said tempo comprises a reference musical figure with respect to which said displayed notes can be represented and a value indicating the amount of reference musical figures to be played per time unit.

* * * * *